United States Patent [19]

Esposito

[11] 4,278,289

[45] Jul. 14, 1981

[54] FISHING CHAIR

[76] Inventor: John W. Esposito, 505 Shore Acres Ave., North Kingstown, R.I. 02852

[21] Appl. No.: 69,123

[22] Filed: Aug. 23, 1979

[51] Int. Cl.[3] ..... B63B 29/04; A47C 7/62

[52] U.S. Cl. ..... 297/188; 9/7; 297/349; 297/423; 297/431; 297/217

[58] Field of Search ..... 297/71, 431, 349, 188, 297/423; 114/188, 194, 217; 9/7

[56] References Cited

U.S. PATENT DOCUMENTS

| | | | |
|---|---|---|---|
| 795,504 | 7/1905 | Hale | 297/431 X |
| 3,140,892 | 7/1964 | Shubart et al. | 297/71X |
| 3,151,910 | 10/1964 | Larson | 297/349 |
| 3,278,224 | 10/1966 | Dlouhy | 297/71 X |
| 3,736,897 | 6/1973 | Krutz | 9/7 |
| 3,747,881 | 7/1973 | Akaniu | 297/188 X |
| 3,851,916 | 12/1974 | Quartullo | 297/188 |
| 3,964,713 | 6/1976 | Josylyn | 297/349 X |
| 4,008,500 | 2/1977 | Hall, Jr. | 9/7 |
| 4,063,321 | 12/1977 | Nichols | 9/7 |
| 4,085,473 | 4/1978 | Franklin | 114/188 X |
| 4,086,676 | 5/1978 | Arruza | 9/7 |
| 4,143,436 | 3/1979 | Jones | 9/7 |
| 4,184,281 | 1/1980 | Corby | 9/7 |

FOREIGN PATENT DOCUMENTS

| | | | |
|---|---|---|---|
| 1102100 | 5/1955 | France | 297/349 |

*Primary Examiner*—James T. McCall

*Attorney, Agent, or Firm*—Barlow & Barlow

[57] ABSTRACT

A fishing chair is provided in which the chair is mounted for rotatable movement about a supporting member, the chair unit being particularly constructed to mount in a single integral seat support, the butt holder for the fishing rod as well as the anchor point for the foot rest so that all of the forces that arise when playing a fish will be concentrated on an integral unit.

6 Claims, 4 Drawing Figures

FISHING CHAIR

BACKGROUND OF THE INVENTION

Fishing chairs which are used for fishing for large game fish such as marlin, tuna, sword and the like, have long been known and have generally consisted of a supporting column about which a chair is swivelly mounted. An early example of a fishing chair is seen, for example, in the McCoy U.S. Pat. No. 1,406,571. Foot rests which are associated with the chair became necessary when one realized that, in effect, when fighting a big game fish, the fisherman found himself utilizing his feet as support while working the fishing rod. Examples of fishing chairs with foot rests are seen as, for example, in the Larson patent U.S. Pat. No. 3,151,910 and in the Quartullo patent U.S. Pat. No. 3,851,916.

SUMMARY OF THE INVENTION

A fishing chair is provided in the form of a chair seat which is supported on a unitary member that will revolve about a vertical standard or column which is adapted to be fastened to the deck of a boat. The unitary support for the chair or seat is made up of a casting that includes a collar that can encircle the supporting column and resting the top of the collar is a seat support plate that includes an anchor in the form of a web for the foot rest and also a pair of parallel flanges which extend forwardly of the seat cushion to support the rod butt holder. With this type of construction all of the forces that are utilized in fighting big game fish which includes one's arms and one's feet and leg muscles are concentrated in one integral unit so that the fishing chair has great durability. In addition, the positioning of the collar with respect to the seat is towards the forward portion of the seat which tends to reduce the turning circle of the chair with the foot rest mounted thereon.

DESCRIPTION OF THE PREFERRED EMBODIMENT

Figure 1:
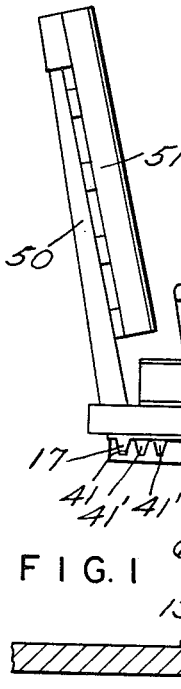
FIG. 1 is a side elevational view of the fishing chair constructed in accordance with the invention.
Figure 4:
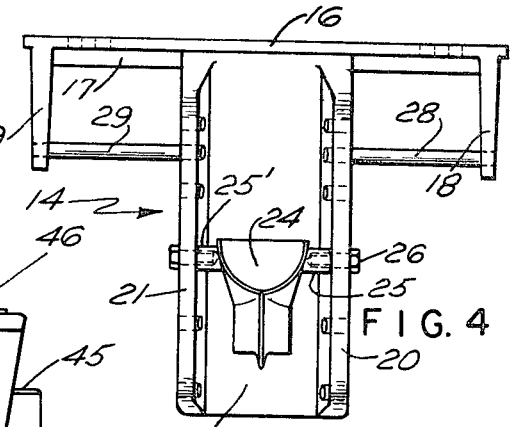
FIG. 4 is a front view of the basic seat support.
Figure 3:
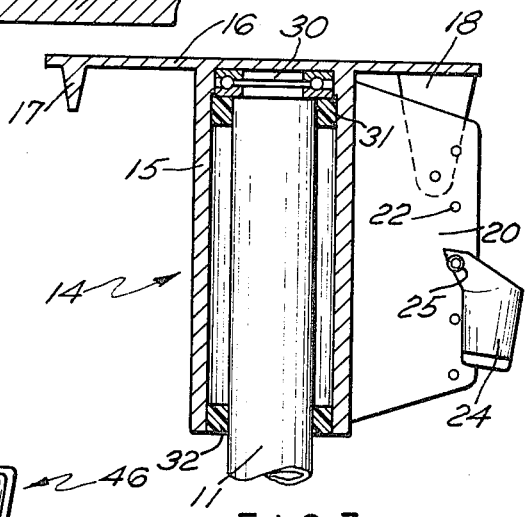
FIG. 3 is an enlarged view partly in section of the basic seat support.
Figure 2:
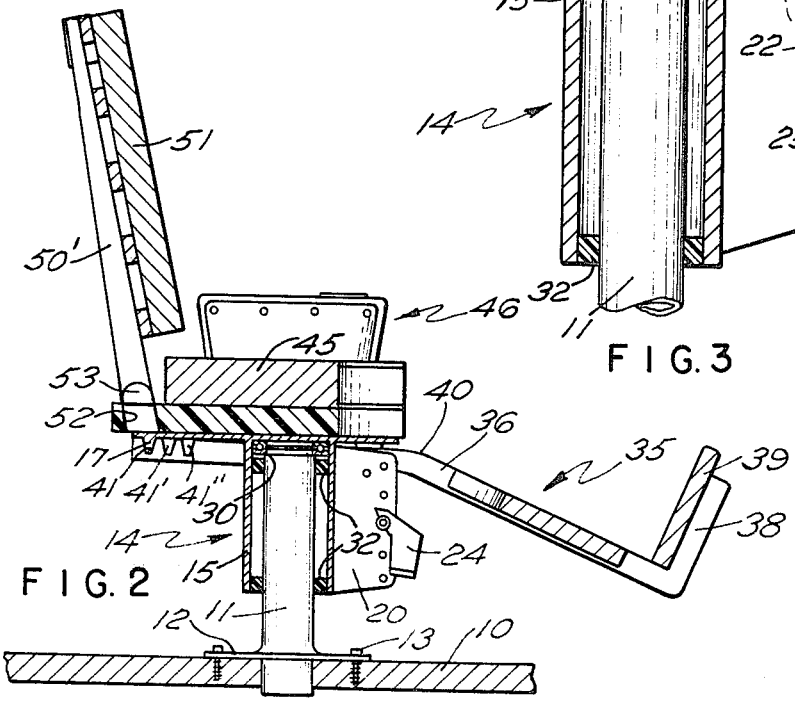
FIG. 2 is a view similar to FIG. 1 with certain parts broken away for clarity and taken substantially just off the central longitudinal line of the chair.

As seen in the drawings, the fishing chair is mounted on a deck 10 or other suitable part of a boat and includes a supporting column 11 having a flange base 12, the latter of which is fastened to the deck by means of bolts 13 or some other suitable fastening elements. Received about the column 11 (see FIGS. 2 and 3), is a seat support unit generally designated 14 which has a collar 15 of elongated shape that extends about the column 11 and has fixedly placed at the top end thereof a seat support plate 16 that in turn has an integral depending web 17 and a pair of depending lugs 18, 19. Extending forward from the collar 15 and tangentially thereof are a pair of parallel spaced flanges 20, 21. The flanges 20 and 21 are provided with a plurality of apertures as at 22 and a butt holder 24 which is provided with a pair of bosses 25, 25' extending therefrom may be fastened by bolts such as 26 passing through apertures 22 at a height which is suitable for the fisherman. To this end, the butt holder 24 is vertically adjustable. Extending between the lug 18 and the flange 20 is a support rod 28 and similarly disposed on the opposite portion between flange 21 and lug 19 is another support rod 29, the purpose of which will presently appear.

The entire seat support rests on the column 11 there being a thrust bearing 30 between the top of the column and the bottom face of the seat plate 16 (see FIG. 3) and rotational alignment is provided by spaced bearings 31, 32 which can take a variety of forms. For example, inasmuch as the fishing chair is commonly used around salt water, it has been found expeditious to make the bearings 31, 32 of P.T.F.E. or similar plastics, such as some of the nylon series, and the filled plastics which exhibit superior bearing qualities.

A foot rest by the chair is shown generally at 35 and includes a pair of arms 36, 37 which are bent at right anglew as at 38 to receive a foot plate 39 and thence are bent slightly as at 40 to extend rearwardly underneath the support plate 16 at which location they are provided with a plurality of notches as, for example, the notches indicated at 41, 41' and 41'', which notches engage the web 17. The rearwardly extending portion of the arms 36, 37 rest respectively on the rods 28, 29 for slidable movement thereacross, and it will be apparent that the notched portions of the arms may be selectively engaged with the web 17 to permit the entire foot rest to be moved toward or away from the seat making it adjustable to suit the individual physical requirements of different persons using the fishing chair.

To the seat plate 16 there may be fitted a cushion bottom 44 which could consist of a molded fiberglass section, and resting on this may be a cushion 45. Also arm rests generally designated 46 may be provided and a seat back 50 may be attached to the portion 44 and provided with a cushion 51. For simplicity the seat back may consist of a pair of frame members in spaced relationship which pass through an aperture such as 52 so that the seat back may be conveniently removed when desired. Also as is customary a locking device such as is operated by a handle 60 may be provided that will engage the column 11 and prevent the chair from rotating when not in use.

It will be apparent that the arrangement disclosed herein concentrates all of the forces from the rod butt holder 24 through the flanges 20 and 21 into an integral place, the foot rest 35 being also anchored as by web 17 into position so that as one is fighting a fish he virtually stands on the foot plate 39 and all the load is concentrated into the integral member 14. It will, of course, be apparent that certain modifications to the seat support can be made as, for example, the collar 15 and the flanges 20 and 21 may be made of one casting and thence welded thereto may be the plate 17 including the web 17 and the depending lugs 18 and 19. This facilitates the assembly of the device and more particularly the casting of the same and yet provides a firm structural member.

I claim:

1. A fishing chair which comprises in combination a supporting column, a chair unit rotatable with respect to the column, a foot rest for said chair unit and a fishing rod butt holder, said chair unit having an integral seat plate and support means that provides an anchor for the butt holder for the fishing rod together with a support for said foot rest, said seat plate having an integral anchor for the foot rest whereby all of the forces created by a fighting fish and the forces of the fisherman whose legs push against the foot rest are concentrated on the chair unit.

2. A fishing chair as in claim 1 wherein the chair unit has a collar depending from the seat plate that is rotatable about said column.

3. A fishing chair as in claim 2 wherein the foot rest has a pair of arms and said support means comprises a pair of spaced integral flanges that extend outwardly from the collar, the ends of the arms engaging said integral anchor on a portion of the chair unit spaced from the slidable support.

4. A fishing chair as in claim 3 wherein the integral anchor is a web depending from the seat plate, the ends of the foot rest arms being provided with notches to adjustably engage the web.

5. A fishing chair comprising a supporting column, said column receiving an integral seat support unit having a collar for rotation thereabout, said unit having a seat plate with an integral depending web, parallel integral vertical flanges extending forwardly from the collar supporting a fishing rod butt socket, a foot rest having a pair of arms, said arms being slidably supported by means on said flanges and adjustably engaging said web.

6. A fishing chair comprising a supporting column, said column receiving a cylindrical collar having integral parallel flanges extending tangentially to said collar, an integral seat support plate fixedly secured to the top of said collar, said plate having an integral depending web on one side of said collar and a pair of integral lugs on the other side thereof, said lugs being spaced from said flanges, a fishing rod butt socket adjustably secured to said flanges, a foot rest having a foot plate and a pair of arms extending therefrom, said arms being provided with notches to engage said web and being slidably supported on means extending between said lugs and said flanges.

* * * * *